US008581513B1

(12) United States Patent
Reinoso

(10) Patent No.: US 8,581,513 B1
(45) Date of Patent: Nov. 12, 2013

(54) BATTERY POWERED WIRELESS DMX LED LIGHTING SYSTEM

(75) Inventor: Jhansen Reinoso, Miami, FL (US)

(73) Assignee: Leilani Reinaso, Miami Gardens, FL (US)

( * ) Notice: Subject to any disclaimer, the term of this patent is extended or adjusted under 35 U.S.C. 154(b) by 0 days.

(21) Appl. No.: 13/451,541

(22) Filed: Apr. 20, 2012

(51) Int. Cl.
*G05F 1/00* (2006.01)

(52) U.S. Cl.
USPC ..... 315/291; 315/307; 315/247; 315/185 S; 315/312

(58) Field of Classification Search
USPC ..... 315/291, 294, 312, 316, 324
See application file for complete search history.

(56) References Cited

U.S. PATENT DOCUMENTS 6,166,496 A 12/2000 Lys
6,211,626 B1 * 4/2001 Lys et al. ..... 315/291
7,233,115 B2 6/2007 Lys
7,309,965 B2 12/2007 Dowling
7,355,523 B2 * 4/2008 Sid ..... 340/9.16
7,432,803 B2 * 10/2008 Fails et al. ..... 340/531
7,969,102 B2 * 6/2011 Chang ..... 315/318
2005/0248299 A1 * 11/2005 Chemel et al. ..... 315/312
2006/0262544 A1 * 11/2006 Piepgras et al. ..... 362/373
2008/0094005 A1 4/2008 Rabiner
2010/0141153 A1 * 6/2010 Recker et al. ..... 315/149
2011/0013395 A1 1/2011 Melzner
2011/0157245 A1 * 6/2011 Young ..... 345/690
2011/0181200 A1 * 7/2011 Luk et al. ..... 315/294
2012/0049765 A1 * 3/2012 Lu et al. ..... 315/312

* cited by examiner

*Primary Examiner* — Tuyet Thi Vo
(74) *Attorney, Agent, or Firm* — Christopher J. Vandam, PA; Chris Vandam

(57) ABSTRACT

A DMX based wireless, light emitting device and system including wireless modules that are battery powered and wirelessly receive and transmit DMX to other modules or a controller device. The modules can optionally be hard wired to both a DMX signal and external power supply. An integrated processor can independently control a pre-selected lighting effects, channels, addresses, programs and other light effect features.

14 Claims, 5 Drawing Sheets

BATTERY POWERED WIRELESS DMX LED LIGHTING SYSTEM

This non-provisional patent application takes priority from pending provisional patent application No. 61/477,029, filed on 19 Apr. 2011 and pending non-provisional patent application Ser. No. 13/449,952 filed on 18 Apr. 2012 and pending non-provisional patent application Ser. No. 13/450,950, each by the same inventor, and these are hereby incorporated herein in their entirety by reference.

BACKGROUND OF THE INVENTION

1. Field of the Invention

The present invention relates to special event lighting, and more particularly, to a modular, self-contained and networkable dynamic lighting system.

2. Description of the Related Art

Several designs for Digital Multiplex (DMX) compliant devices have been designed in the past. However, none of them include, among other features, the capabilities in a battery or hard-wired self-contained device that can wirelessly or via wired DMX cables seamlessly work with other similar modules to produce a highly controlled lighting effect system when used alone or in combination with multiple other substantially identical modules working in concert.

Prior art devices for event lighting generally require a wired signal connection and wired power connections. Some devices have recently become available that provide some limited wireless capabilities but fail to include elements in a unified form factor including, inter alia, multi-colored light emitting diodes (LED) that are independently and fully controllable either automatically, wirelessly or wired and that connect to a other similar modules or a dedicated controller.

Other patents describing other related subject matter provide for a number of more or less complicated features that fail to solve the problem in an efficient and economical way. None of these patents suggest the novel features of the present invention.

SUMMARY OF THE INVENTION

It is one of the main objects of the present invention to provide a wireless and cordless lighting effects module that is highly functional on its own and also flexible to seamlessly integrates multiple modules and other third-party systems.

It is another object of this invention to provide a device that can dramatically extend the range of DMX lighting systems by wirelessly connecting modular device in series.

It is still another object of the present invention to provide a multi-channel DMX based modular device allowing control of multiple LED lights to affect color, pattern and luminosity.

Another object of the invention is to provide a battery operated, self-contained modular lighting effects system.

In yet another aspect, the battery powered wireless lighting system is especially useful for production companies, event companies, party companies, DJs, hotels, clubs, banquet halls, etc.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
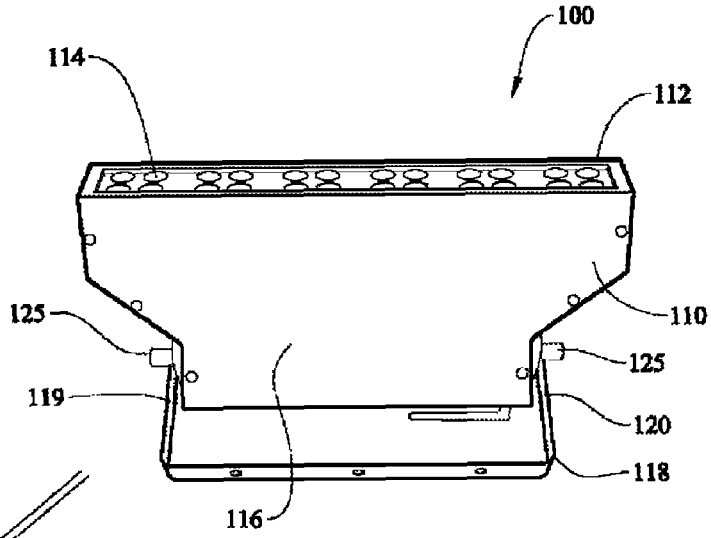
FIG. 1 represents a perspective view of a battery powered wireless lighting module as disclosed herein.

It should be appreciated the invention disclosed herein is sometimes equally referred to as the device, unit, module or sister. Some components that would be readily apparent to one skilled in the art are not always shown in the drawings when sufficient enabling details are provided in this specification to allow for use and manufacture of the invention without undue experimentation.

Referring now to the several sheets of drawings, where the present invention is shown in exemplary forms, it can be observed that in an important version it generally includes at least one lighting module 100, a wireless transmitter 200 and a ceiling structure 300. The lighting module 100 is shown to further include an outer casing 110, a frontal portion 112, a set of LEDs 114, a side panel 116, a rotatable bracket 118, legs 119, legs 120, adjustable bolts 125 and a cooling fan 130. The transmitter 200 is shown to further include an outer casing 202, an antenna 210, controls 215 and a digital display 220.

Figure 3:
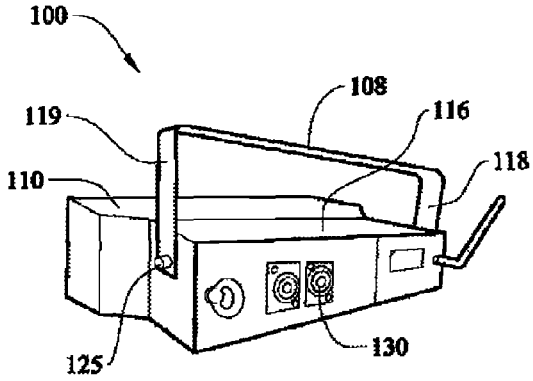
FIG. 3 illustrates an alternate perspective view demonstrating the rear side of a version of the device.

With reference to the drawings and specification, a battery powered wireless DMX LED lighting system includes at least one lighting module 100 and a wireless transmitter 200 is shown. The lighting module 100 includes an outer casing 110 with a frontal portion 112. A set of LEDs 114 are located on the frontal portion 112. A rotatable bracket 118 is pivotally mounted on ends of the lighting module 100. The bracket 118 includes a U-shaped arm with attachment legs 119 and 120 pivotally attached to the outer casing 110 by means of adjustable bolts 125. The bracket 118 allows the feature to be hung for stage lighting, and also allows the user to adjust the height and the angle of the light. FIG. 3 shows a cooling fan 130 on a rear of the lighting module 100.

Figure 2:
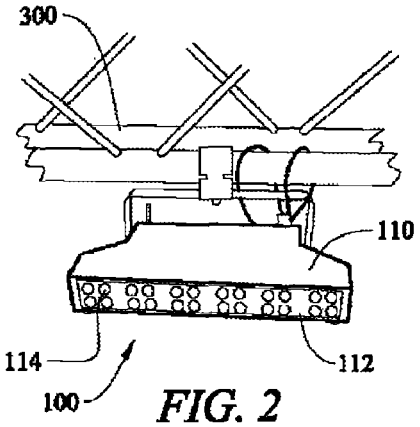
FIG. 2 shows a perspective view of a version of the device as it may be in use affixed to a mounting structure.

The wireless transmitter 200 includes, inter alia, an outer casing 202, an antenna 210, controls 215 and a digital display 220. The wireless transmitter 200 also includes DMX connections. With reference to FIG. 2, the lighting module 100 may be hung from a ceiling structure 300 for a stage lighting or other similar application. However, mounting of the lighting module 100 should not be limited to that shown in FIG. 2, but should include other mounting methods, such as down lighting, floor lighting, or the like.

An important version of the lighting module 100 of the battery powered wireless DMX LED lighting the system preferably includes at least the following features:

- Rechargeable Battery with up to 18 hours of battery life
- Digital battery power indicator 0-100%
- External power source alternate to the battery that can also be used for charging the battery
- Wireless DMX-512 protocol
- Built in receiver/transmitter for wireless DMX operation
- Auto-jumping channel frequencies with high anti-jamming ability
- Multiple unique transmitter and receiver codes
- Wired DMX protocol connections
- RGBW color mixing (Optional: RGBA)
- 24-1 Watt Edison LED 6 red, 6 green. 6 blue, 6 white
- 45 degree lenses (Optional: 15°, 25°, 30° lenses)
- Electronic Dimming 0-100%
- LED display and function buttons for address and function setting
- Control DMX channels 4, 8, 24 or 28 CH
- Master/Slave Synchronization via wireless and wired
- Operation modes: DMX, sound active and auto modes
- Built in microphones for sound active mode
- Dual bracket for floor stand or hanging mount
- Dual eye bolts for safety and security cables FIG. 1 shows a version of the device as it may be in use on a horizontal surface such as the floor or a table. A plurality of sets of LEDs 114 are on a frontal portion 112 of an outer casing 110. A rotatable bracket 118 is articulably attached to the outer casing 110 by means of leg 119 and leg 120. Leg 119 and leg 120 are adjustably affixed to the outer casing 110 by means of adjustable bolts 125 on either side of the outer casing 110. The adjustable bolts 125 may be in the form of a knob that can be threaded tightly thereby holding the relative angle between the outer causing 110 and the legs 119-120. The rotatable bracket 118 connects leg 119 to leg 120. Rotatable bracket 118 serves as a support member when setting on a horizontal surface such as the ground or it can be used to hang the device from a truss.

FIG. 2 shows the module 100 as it may be hung from a truss. This configuration is typical if the system is used, for example, for stage wash lighting.

FIG. 3 shows the back side of a version of the device where a cooling fan 130 is shown. Cooling is preferred for the device to maintain optimum efficiency of the battery and lights and helps provide longevity of all of the internal components by maintaining a suitable temperature inside the device. Optionally a thermostat is provided to aid in conserving battery power by only turning the fan on if and when needed to cool the device. Preferably if the device is powered by an external power source then the fan may run constantly.

Figure 4:
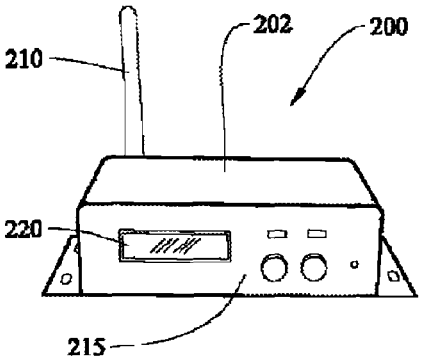
FIG. 4 is a representation of a perspective view of a wireless transmitter that optionally may be used with the lighting system.

FIG. 4 shows a DMX wireless transmitter 200. Generally, the wireless transmitter 200 receives a wired DMX signal and converts it to a wireless signal and transmits via the antenna 210. The wireless transmitter 200 can add DMX instructions to the signal which is accomplished by controls 215 and reflected in the digital display 220.

Figure 5:
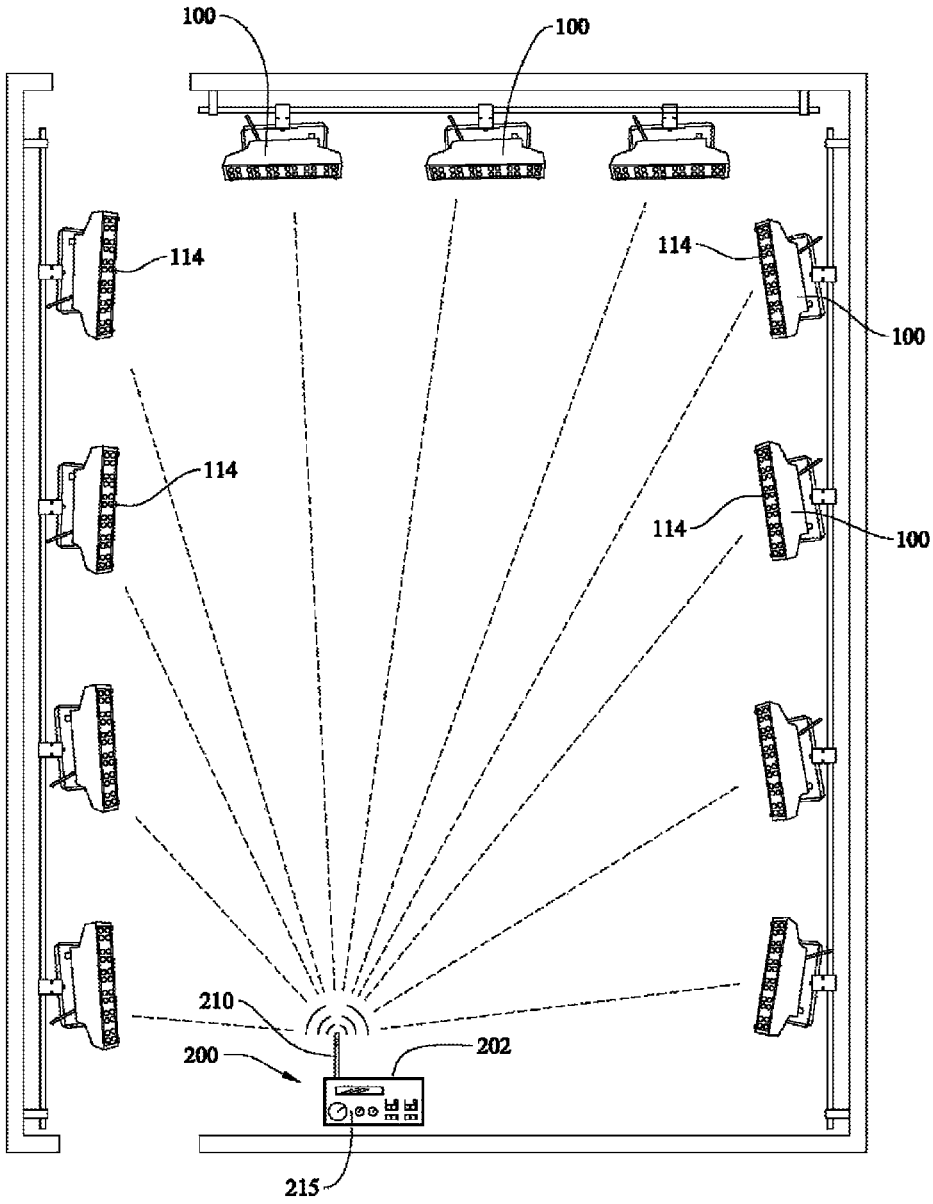
FIG. 5 shows a plan view of an example of a room layout where multiple devices are shown and a wireless transmitter is shown in perspective view.

An example of a composite wireless DMX lighting system is demonstrated in FIG. 5 to include a plurality of lighting modules 100 that are mounted around a perimeter of a venue and controlled with a single wireless transmitter 200. The wireless transmitter 200 sends a DMX signal and/or instructions to each of the lighting modules 100 within range. In this example, each of the wireless transmitters 100 are operated on internal battery power and wirelessly receive the DMX signal from the wireless transmitter providing a fully wireless system. Some wireless transmitters 200 may require an external power supply. However, this is rarely a problem because the wireless transmitter can be placed in any location that is convenient for the application. Thus the wireless transmitter 200 may be placed out of the way, near a wall power outlet.

The wireless controller 200 generally can send signals to the lighting modules to turn them on or off, change the color of the light emitted by the sets of LEDs 114, change the program or pattern, intensity, change rate and control other effects and features as may be needed or available on the lighting modules in use.

The present invention provides a battery powered wireless or wired DMX LED lighting system. Generally, DMX is a system or protocol for controlling lighting fixtures and dimmers. Commonly these are for temporary or semi-permanent installations, for example, such as for special events, multimedia events, presentations or concerts. DMX technology itself has several applications. For example, a wide variety of lighting control consoles, controllers and other devices that output or input DMX signals can be used to connect and control a wide variety of commercially available of lighting fixtures, devices and accessories for control by DMX. DMX is a frequently used technology for many professional lighting and special effects applications.

Another common use of DMX technology includes architectural applications. For example, architectural lighting projects, including illumination of building exteriors, accent lighting, general purpose building management, and high-end residential lighting. This is due primarily to the high popularity of LED-based lighting fixtures, which can be controlled via DMX equipment and signals.

DMX 512, an important version of the DMX standard, is popular partly due to its robustness. The cable can be abused without material loss of function in ways that would render Ethernet or other high-speed data cables useless. Cable faults or other damage can occasionally lead to problems, such as random triggering or other failures. However, usually unexpected fixture behavior is caused by addressing errors, cable faults, or incorrect data from the controller.

Recently, wireless DMX 512 adapters with limited functionality have become available, especially in architectural lighting installations where cable run lengths can be prohibitively long or have other intervening features that make wired applications problematic. Such networks typically employ a wireless transmitter at the controller with strategically placed receivers near the fixtures to convert the wireless signal back to conventional DMX 512 wired network signals. This creates a complicated array of DMX signal wires, power cables and the requisite adapters that all require labor to set-up, take down, store and keep track of. A benefit of the present invention is that all of the previously required elements are integrated with each other so that each element is adapted to interact together synergistically, all contained in a stout case.

It should be appreciated that the references to DMX are intended to include the several versions and variations included in the DMX standard as promulgated by the Engineering Commission of United States Institute for Theatre Technology (USITT) or the Entertainment Services Technology Association (ETSA) as well revisions and improvements as may become available from time to time.

Early wireless DMX 512 systems were based on frequency-hopping spread spectrum (FHSS) technology using commercial wireless modems. Somewhat later some manufacturers used WiFi/WLAN technology adapting systems from computer based network systems. Higher bandwidth, improved protocols and variable channels and frequencies have been in development over the past several years. FHSS systems have a tendency to sometimes interfere with WiFi/WLAN based systems. Improvements have been made in newer wireless DMX systems by using adaptive frequency hopping and cognitive coexistence (AFH-CC), a technique to detect and avoid surrounding wireless systems, to avoid transmitting on frequencies utilized by other devices.

An important version of the invention provides a battery powered wireless DMX LED lighting device and system, including a lighting module having a multiplicity of low watt lights. For example, 24-1 watt LED's comprised of 6 red, 6 green, 6 blue and 6 white. Obviously many more or less quantity of LED's may be effectively used. Each device in the system is powered by a long life battery. For example, most applications would be well suited with an 18-hour life battery. Also included in the device is an integrated wireless transmitter and receiver, ideally with a 1,300-feet range. The wireless transmitter and receiver are adapted to receive and transmit a wireless DMX signal or other appropriate signals affecting the utility of the lights.

Now referring to FIGS. 6, 7, 8 and 9 where a preferred version of the device is shown to further include a case 132, a bracket 134, a bracket 136, a fastener 138, a fastener 140, a grille 142, an antennae 144, a vent 146, indicators 148, apertures 150, a switch 152, a switch 154, a microphone 156, a switch 158, a switch 160, fuses 162, a socket 164, a socket 166, a socket 168, a socket 170, a display 172, controls 174, a ring 176, a light cluster 178, a controller 180, a module (generally) 182, a prior art DMX fixture 184, a cable 186, a safety line 188, a truss 190, a cable 192, a wireless signal 194, a light 196, a light 197, a light 198 and a light 199.

Generally, the case 132 is provided to house the various internal components including a battery, a battery charger, a processor, a power regulator, the light clusters 178 and other elements as described herein. The rear panel of the case 136 has the controls for the various features and settings of the device. In this embodiment, switch 152 is an on-off switch for use when the device is powered by an external power source. The external power source is connected to the device at socket 164. The external power source can be used both to operate the device when not on battery power and can also be used to recharge the battery.

Said case 132 may optionally be constructed to waterproof standards or weather resistant standards to allow safe operation in a wide variety of conditions.

Switch 154 is a three way rocker switch that controls the battery. Switch 154 has selections to run on battery power, isolate the battery (off) and charge the battery. Power must be supplied from outside the device to charge the battery. To charge the battery the switch 152 is in the off position and switch 154 is moved to charge thus allowing current to flow from outside the device, to the battery charger and into the battery. When the device is not in use and is not charging then switch 152 and switch 154 are both in the off positions.

Switch 158 is provided to independently turn the wireless transceiver on and off. By providing the wireless transceiver switch 158 battery supply can be saved when the DMX signal is inputted to the device via a traditional hard wire.

The microphone 156 is used in conjunction with the sensitivity switch 160. In one mode of operation the microphone 156 picks up ambient sounds, such as the beat of music played, and with the help of the processor can synchronize the light show outputted with the beats. This creates an effect of the light show produced by the device being in automatic coordination with the sounds in the room. The sensitivity switch 160 can adjust the levels of sound in the room that are picked up by the microphone 156. This effectively allows a sound active mode where the lighting effects work seamlessly and automatically with the music or other sounds in the area.

Because the device can be operated on either battery power or an external power source, fuses 162 are provided to protect the components of the device. In this example, one fuse is to protect the battery circuit and the other fuse protects the alternating current supplied external to the device for hard wired power and power coming into the device during charging of the battery.

Socket 164 is an input for an external power supply for powering the device itself and charging the internal battery. Socket 166 is provided to connect a subsequent device, whether another sister device (another copy of the invention) or a third-party device, to the external power supply. This is effect creates a daisy chain for the power supply. This is useful for some applications where it would be difficult to provide separate individual power cords to each modular device. For example, if multiple devices are affixed adjacently to a stage gantry then only one power cable need to supplied to the first module in the series and then short cable runs between the modules are required to supply grid-power (as opposed to battery power) to each module. Of course, an external power supply could be in the form of solar panels, a fueled generator, wind turbine or any other available locally produced or municipal power supply, as appropriate in the context.

In similar fashion to the power input socket 164 and output socket 166 there is provided a DMX signal input socket 168 and output socket 170. If the user of the device wishes to hard wire a DMX signal cable into the device input socket 168 accepts that cable. The DMX signal can then be outputted through DMX cable connected to socket 170 in daisy chain fashion. For example, if several modules are placed around a DJ table it may be preferable to simply hardwire the adjacent devices to each other with a hard cable from a DMX controller to the first module at socket 168, then out from the socket 170 on the first module to the socket 168 on the second module, then out from the second module at it's socket 170 to the input socket 168 on a third module, and so on, indefinitely.

Figure 8:
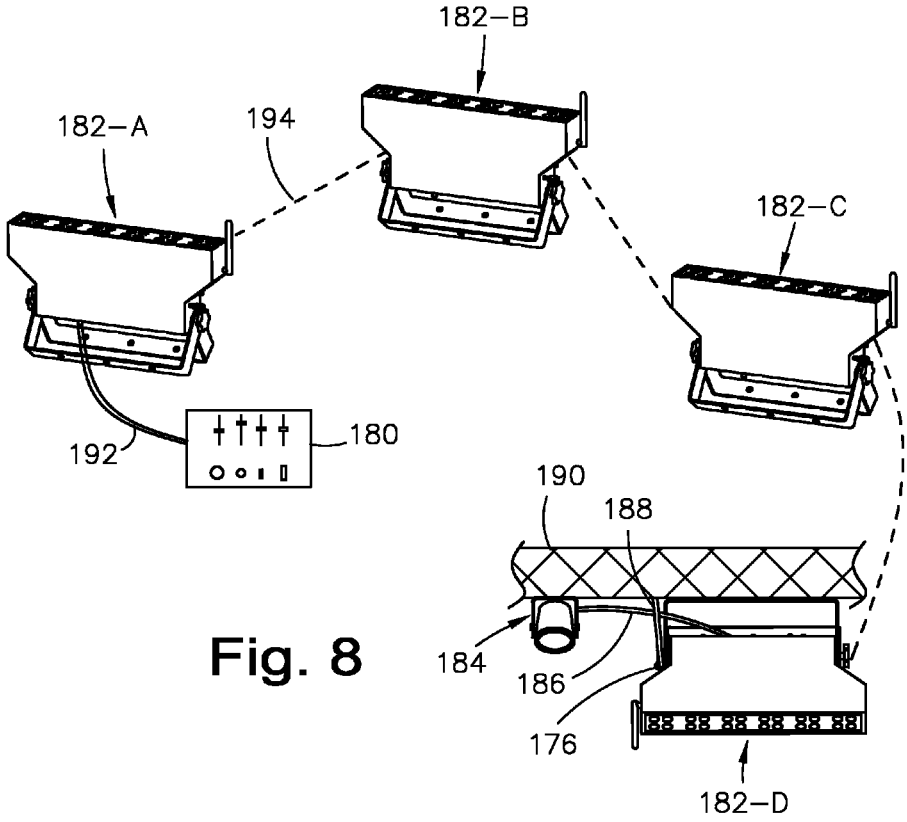
FIG. 8 represents a perspective view of multiple modules used in conjunction with a prior art device.

An important feature of the invention is to be able wirelessly relay the DMX signal from any module to a sister-module. Referring now to FIG. 8 where a system of multiple devices is shown with other non-claimed elements. In this example module 182-A is a master module. Module 182-A is connected via DMX cable 192 to a controller 180. Module 182-A then relays the wireless signal 194 to module 182-B which in turn relays the signal 194 to module 182-C and again on to module 182-D. As should now be apparent, this can greatly extend the overall range that a DMX signal can be transmitted. Practically, the signal could be relayed over many miles when there are a series of modules spaced at distance where one module can relay to the next repeatedly.

Still referring to FIG. 8, the last module 182-D in the daisy chain is affixed to a truss 190, such as may hold speakers and lights over a sound stage. A prior art device 184 is depicted near the module 182-D. The prior art device 184, without a wireless DMX capability, is connected to a DMX cable 186 on one end to the DMX output socket 170 on module 182-D on the other end. Typically, a prior art device 184 would require it's own power supply but could also be supplied power from the power output socket 166 on module 182-D if module 182-D is fed external power into it's socket 164.

In this example in FIG. 8, each of the modules 182-A though 182-D are operating under battery power but could equally be powered by an external source, as described above, or any combination of battery and externally sourced power.

The controller 180 in FIG. 8 is merely an example showing a four channel configuration and it should be appreciated that many more channels could equally be available with a larger controller. Also, the controller 180 could wirelessly connect to module 182-A, or any other module within wireless range. An example of a wireless controller means is shown in FIG. 4, described supra.

Yet referring to FIG. 8, the ring 176 integral to the case 132 provides a safety and security means by allowing the module 182-D to be tethered to the truss 190. Obviously, each of the several modules in this example could be secured to another object preventing theft or providing a backup means to attach the module to an overhead structure to add a level of safety should the module inadvertently become unattached from the support structure, thereby avoiding a fall.

Figure 7:
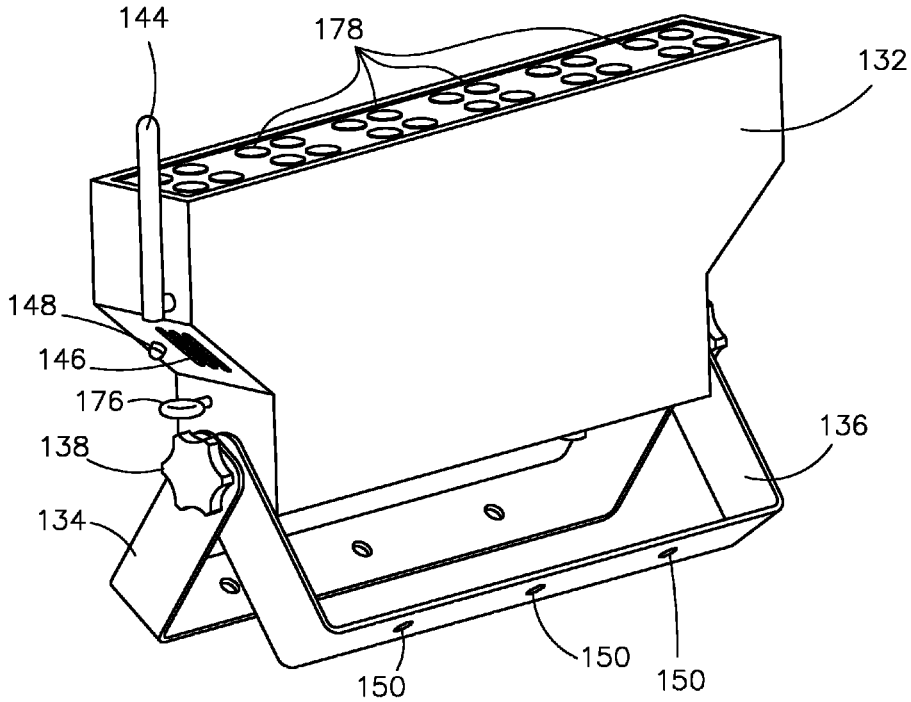
FIG. 7 shows a perspective view of the device as it may be set up on the floor for up lighting.
Figure 9:
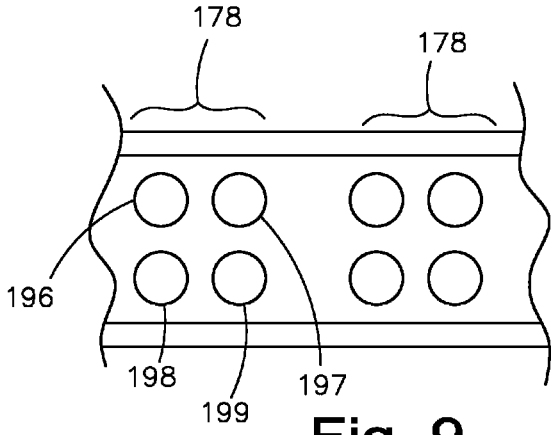
FIG. 9 is a partial plan view of light clusters on the lighting side of the device.

FIG. 9 is a close-up of the light emitting surface of the device emphasizing a pair of light cluster 178. Light cluster 178 are each preferably comprised of a cluster of a light 196, a light 197, a light 198 and a light 199. The light clusters 178 preferably have one each of a red, green, blue and white light emitting diode (LED). Multiple light clusters 178 are positioned adjacent to each other on the light emitting face of the device, as shown in FIG. 7 and as a partial close-up view in FIG. 9.

Light clusters 178 could also effectively be comprised of additional LED lights with redundant colors or additional colors. Each individual light 196 through 199 could also be constructed of a varying wavelength LED so that each individual LED could be independently adjusted for color. Color is intended to include any of the visible light spectrum as well as wavelengths from about the infrared to the ultraviolet. A 'black light' feature provided by the LEDs is particularly useful for inclusion in the device.

The quantity and position of the light clusters 178 on the device as well as the composition of the individual elements (i.e. single LEDs) are variable as the application of the device requires. For example, a version including all one color of LED lights may be better suited to a particular application such as for a photography light source or emergency lighting an all-white LED configuration may be preferred.

Referring back to FIGS. 6 and 7 where each figure shows an individual module, a display 172 and controls 174 are provided to manually allow the user to control the device's settings and program. A central processing unit, described in more detail infra, is connected to the display 172 and controls 174. In a primary version of the device a series of menus and commands may be accessed by the controls 174.

For example, the DMX addresses may be assigned so that a wireless controller can access the appropriate features. In this example, if the address is assigned 'four', then four aspects of control are made available to the wireless controller. These four could be red, green, blue and white so that the wireless controlled can affect the intensity of each of these addresses (i.e. colors) independently. The operator of the device then has variable control over these aspects to mix and match intensity of each color LED resulting in a wide verity of net mixed colors.

In a related example, if the address is assigned a value of eight, then in addition to the individual four colors, supra, additional controls are available for a programmed pattern, intensity, speed and strobe effects. If the wireless controller has the capability then additional address can be made available to control individual LEDs which is essentially pixel mapping so that a more defined pattern can result from the light shone by the LEDs. Generally, the more addresses that are recognizable by the module the more control the operator has over the various aspects of the resulting light produced.

It should be appreciated that there may be many more addresses, such as five hundred twelve in the DMX 512 protocol. The present system can equally be adapted to any number of additional addresses to control additional features. Additional DMX interfaces may also be simultaneously used to provide control over an increased number of modules and their respective light clusters and individual LED lights.

Yet referring to the display 172 and controls 174, the menus can allow the operator to select a variety of pre-programmed effects. These may include, by way of example, fades, strobes, chases, speeds and demo programs. The characteristics of the demo programs may also be tuned for speed, hue saturation and other attributes.

The display 172 can preferably be used to display other facets including remaining battery capacity. For example, a percentage of total battery capacity remaining may selectively be displayed.

The controls 174 and display 172 can also be used to set manual programs. For example, module can be set to produce a single color, a sequence of colors, strobe effect or other programs including speed and intensity settings. Demo cycles are also optionally selected.

Figure 6:
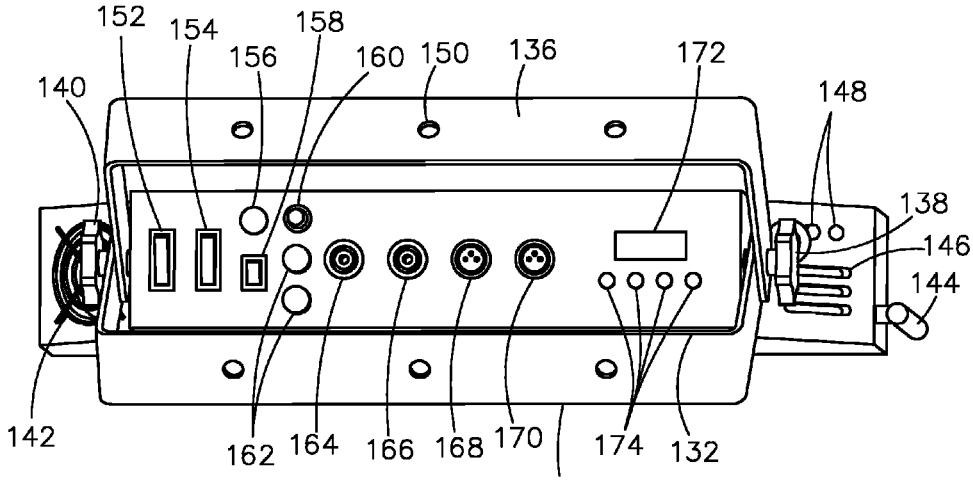
FIG. 6 is a perspective view of the control panel side of the device.
Figure 10:
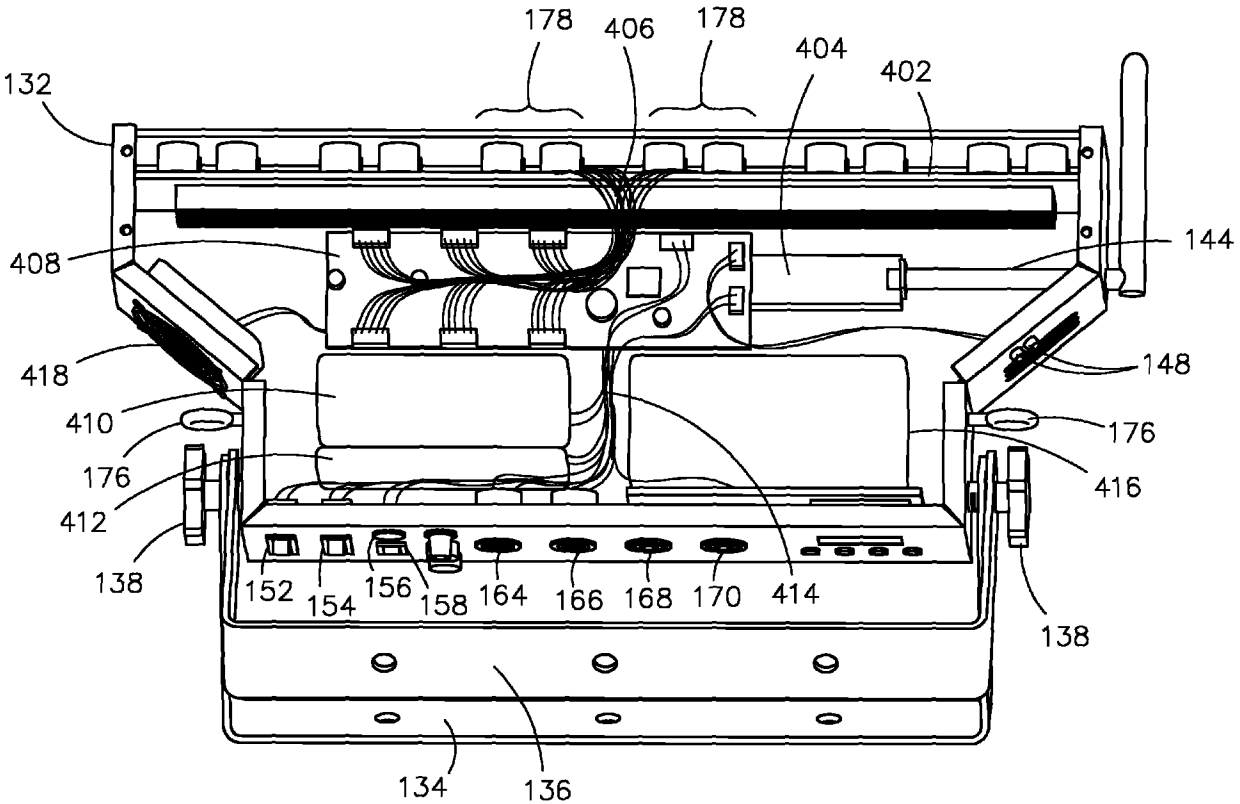
FIG. 10 is a perspective view of the device with a side panel removed to demonstrate the several interior components.

Referring to FIG. 6 in particular, a grille 142 is shown that covers a fan 418 described infra and shown on FIG. 10. The fan 418 draws in air through the case 132 and introduces fresh, cool air by way of the vents 146. Optionally, a thermostat is included to cycle the fan 418 on when required by the internal temperature. By cycling the fan 418 on only when needed, battery power can be conserved. If powered by an external power source, such as regular wall current, then the fan may be always on. Cooling the internal components increases the performance and longevity of the electronic components.

Still at FIG. 6, indicators 148 are provided. In a preferred version indicators 148 are comprised a combination of an LED light and a button switch. The indicators 148 show which wireless channel the device is then set at. Said button cycles between the available channels. This feature is useful when different channels are desired for separate modules or to avoid interference. For example, if the device and system is used for a house party different rooms can each have modules on a specific channel. In this case, a first room can be set to a first channel so that all the modules in the first room are simultaneously controlled. Then, a second room can contain modules set to a second channel so that they can be controlled independently of those modules on channel on in the first room. Therefore, the capability is provided to have a group of modules in one room to be independently controlled from a group of modules in another room, each running a separate program. The channel assignment may also be remotely assignable by a controller unit or may be automatically assigned to the best available channel.

FIG. 7 shows an example of how a module may be set up when used on a floor, table or other horizontal surface. Bracket 136 and bracket 134 act as legs to support the device. Bracket 134 and 136 are articulable about fastener 138 on a first end and fastener 140 on a second end, respectively. The fastener 138 and fastener 140 are essentially threaded handles that can tighten against the case 132 to fix the positions of the bracket 134 and bracket 136. In this manner the light clusters 178 can be directed as the operator desires. The bracket 134 and bracket 136 can be fixed together at a position where they overlap to act as a handle, during storage or for overhead mounting.

The device can be mounted overhead by affixing the bracket 134 and bracket 136 together by tightening the fastener 138 and fastener 140. The series of apertures 150 on both bracket 134 and bracket 136 are provided to accept mounting hardware, such as a bolt or clamp, to securely attach the device to another object, such as a lighting truss. Ring 176 is provided to tether the device to another object for security and safety.

A lens may be provided that covers the light clusters 178. The lens can be configured to focus or redirect the light produced by the light clusters. Lenses may also be provided to bend the light, for example, by 15, 25, 30 or 40 degrees. The lenses are easily interchangeable and may cover some or all of the light clusters 178 in a particular module.

Now referring to FIG. 10 where an example of the internal components are shown to further include a heat sink 402, a carriage 404, a harness 406, a central processing unit 408 (CPU), a charger 410, a converter 412, a harness 414, a battery 416 and a fan 418.

The CPU 408 includes features to control the charging of the battery, DMX signal, wireless signal and all of the features described herein. A wiring harness 414 connects, inter alia, the switch 152, switch 154, microphone 156, switch 158, switch 160, sockets 164-170, the display 172, controls 174, each of the individual LEDs in each light cluster 178, the battery 416, the charger 410, fan 418, antenna 144, indicators 148 and converter 412.

The antenna 144 is provided to extend the range of the wireless signals both sent and received by the device. The antenna 144 is preferably retractable into the case 132 by sliding on a carriage 404. When the operator desires to use the antenna 144 she simply extracts it and when not needed, retracts it inside the protective case 132.

In normal use the battery 416 provides the power to operate the various features of the device. The battery charger 410 is provided to replenish the battery 416. If the battery 416 is not used to power the device then an external power supply may be used which is fed into the device through connector 164 into the power converter 412 where the current is converted to a usable amperage and voltage and avoid damage to the CPU 408 and other electronic components.

Heat sink 402 is provided to extract some of the heat generated by the light clusters 178. In combination with the fan 418, the heat sink 402 aids in cooling the components of the device.

An important version of the invention can be characterized as a DMX lighting module integrated into a single case that includes a rechargeable battery and a battery charger, a central processing unit (CPU) including a memory module that stored light sequence programs that can be outputted to at least one light cluster. It includes a wireless DMX transceiver that can send and receive DMX signals that are controlled by control panel having a display and controls. Said light cluster is comprised of at least one LED light, often multiple lights that are capable of color output and variable dimming. The CPU is adapted to control said light output and said variable dimming of said light cluster. The memory module is adapted to store a predetermined set of light control commands, programs or instructions and the CPU is adapted to execute said light control commands and output said commands to said LED lights. The wireless transceiver is adapted to receive a wireless DMX signal and to execute a command in said DMX signal to activate an LED light.

Important variations or additions include that the CPU is adapted to independently control each LED light and that said light cluster is comprised of at least: one red LED, one green LED, one blue LED and one white LED. Optionally, each LED is capable of variably outputting light in a predetermined range in a spectrum between ultraviolet and infrared wavelengths. Optionally, said battery has about eighteen hours of battery life. Optionally, said wireless transceiver is adapted to relay a preselected wireless DMX signal to a second DMX lighting module. Optionally it includes a microphone and a microphone sensitivity selector.

Also shown is a DMX lighting system comprising the above module or variations thereof and a wireless DMX transmitter where said DMX transmitter transmits a wireless DMX signal to each of said lighting modules.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A portable DMX compliant lighting module integrated into a single case and comprising:

a rechargeable battery, a battery power indicator and a battery charger;

a central processing unit (CPU) including a memory module;

at least one light cluster;

a wireless DMX compliant transceiver with auto jumping channel frequencies that minimize interference;

said wireless DMX compliant transceiver selectable to any of a predetermined set of channels;

a display and controls to control a function setting;

said function setting is selected from any of: a channel selection, a master-slave synchronization mode, an operation mode, a sound active mode, a light control command or a DMX compliant address;

where said light cluster is comprised of at least one LED light that produces color output and variable dimming;

said CPU controls said light output and said variable dimming of said light cluster;

said memory module stores a predetermined set of light control commands;

said CPU executes said light control commands and outputs a signal to said light cluster;

said wireless transceiver receives a wireless DMX compliant signal and immediately wirelessly rebroadcasts that wireless DMX compliant signal and executes a command in said DMX compliant signal to activate a light cluster.

2. A DMX lighting module as disclosed in claim 1 further characterized in that said CPU independently controls each light cluster.

3. A DMX lighting module as disclosed in claim 1 further characterized in that said light cluster is comprised of at least: one red LED, one green LED, one blue LED, one amber, one ultraviolet and one white LED.

4. A DMX lighting module as disclosed in claim 1 further characterized in that each light cluster is capable of variably outputting light in a predetermined range in a spectrum between ultraviolet and infrared wavelengths.

5. A DMX lighting module as disclosed in claim 1 further characterized in that said battery has at least eighteen hours of battery life for use in most applications.

6. A DMX lighting module as disclosed in claim 1 further characterized in that said wireless transceiver transmits a preselected wireless DMX signal to a second DMX lighting module in a master-slave relationship.

7. A DMX lighting module as disclosed in claim 1 further characterized in that it includes a microphone and a microphone sensitivity selector;

when a sound active mode is selected then said microphone picks up ambient sounds and automatically synchronizes a light effect to the ambient sounds.

8. A DMX lighting system comprising:

at least one lighting module as disclosed in claim 1;

a wireless DMX transmitter where said DMX transmitter transmits a wireless DMX signal to said lighting module.

9. A portable lighting module integrated into a single case comprising:

a rechargeable battery, a central processing unit (CPU), a memory module, a control, a light cluster and a wireless DMX transceiver;

the wireless DMX transceiver is operatively configured with the CPU;

the control affects a function setting selected from any of: a channel selection, a master-slave synchronization mode, an operation mode, a sound active mode, a light control command or a DMX compliant address;

the light cluster is comprised of at least one LED light that produces light and variably dims;

the wireless DMX transceiver is selectable to transmit and receive a wireless DMX signal on any of a predetermined set of channels or auto-jumping channel frequencies;

the wireless transceiver receives a wireless DMX signal and the CPU executes a command contained in the DMX signal that activates a light cluster;

the wireless transceiver receives the wireless DMX signal and immediately wirelessly re-transmits the wireless DMX signal.

10. A portable lighting module as in claim 9 further characterized in that a light control command is stored in the memory module and is selectively executed by the CPU to activate a light cluster.

11. A portable lighting module as in claim 9 further characterized in that a power cord is operatively connectable to the rechargeable battery that selectively charges the rechargeable battery and provides independent power to the portable lighting module and provides a power connection socket to power another portable lighting module.

12. A portable lighting module as in claim 9 further characterized in that while connected to an external power source the rechargeable battery can be recharging while the portable lighting module remains operable powered the external power source.

13. A portable lighting module as in claim 9 further characterized in that the rechargeable battery has a capacity allowing eighteen hours of use in most applications.

14. A portable lighting module as in claim 9 further characterized in that a pair of brackets are attached to the case and selectively articulate to:

a first position where the brackets perform as supporting legs and are adjustable to aim a direction of the light cluster; and a second position where the brackets are affixable to a support structure and are adjustable to air the direction of the light cluster; and a third position where the brackets nest against each other to provide a carrying handle.

* * * * *